US007127779B2

(12) United States Patent
Hewes

(10) Patent No.: US 7,127,779 B2
(45) Date of Patent: Oct. 31, 2006

(54) CABLE TIE

(75) Inventor: David A. Hewes, Chesterfield, MA (US)

(73) Assignee: Advanced Cable Ties, Inc., Gardner, MA (US)

( * ) Notice: Subject to any disclaimer, the term of this patent is extended or adjusted under 35 U.S.C. 154(b) by 110 days.

(21) Appl. No.: 11/011,749

(22) Filed: Dec. 15, 2004

(65) Prior Publication Data

US 2006/0123603 A1 Jun. 15, 2006

(51) Int. Cl.
*B65D 63/00* (2006.01)

(52) U.S. Cl. ..... 24/16 PB; 24/17 AP

(58) Field of Classification Search ..... 24/16 PB, 24/17 AP

See application file for complete search history.

(56) References Cited

U.S. PATENT DOCUMENTS 3,965,538 A * 6/1976 Caveney et al. ..... 24/16 PB
4,011,633 A * 3/1977 Seil ..... 24/16 PB
4,135,749 A * 1/1979 Caveney et al. ..... 24/16 PB
4,580,319 A * 4/1986 Paradis ..... 24/16 PB
5,146,654 A * 9/1992 Caveney et al. ..... 24/16 PB
5,263,231 A 11/1993 Sorensen et al.
5,440,786 A 8/1995 Sorensen et al.
5,615,455 A 4/1997 Sorensen et al.
6,526,628 B1 * 3/2003 Caveney et al. ..... 24/16 PB
6,938,305 B1 * 9/2005 Garver ..... 24/16 PB

* cited by examiner

*Primary Examiner*—Robert J. Sandy
(74) *Attorney, Agent, or Firm*—Brian M. Dingman, Esq.; Mirick, O'Connell, DeMallie & Lougee

(57) ABSTRACT

A cable tie with an elongated tongue with two ends and two broad sides, a tip at one end of the tongue, a set of ratchet teeth extending along one broad side of the tongue, and a locking head at the other end of the tongue, the locking head having sides defining an opening for receiving the tip of the tongue, and a movable pawl that is hinged at one side of the opening, with another side of the opening defining an abutment wall that is across the opening from the pawl. The pawl engages with one or more of the ratchet teeth when the tongue has been inserted through the opening with the set of ratchet teeth facing the pawl. The abutment wall defines at least one protruding cross member, to strengthen the abutment wall.

19 Claims, 4 Drawing Sheets

CABLE TIE

FIELD OF THE INVENTION

This invention relates to a cable tie.

BACKGROUND OF THE INVENTION

Cable ties are useful for quickly and securely retaining together two or more items, for example the conductors in a wiring harness. Several examples of cable ties are shown in U.S. Pat. Nos. 5,263,231; 5,440,786; and 5,615,455. In a general sense, a cable tie is an elongated tongue with a tip at one end and a locking head at the other end. A set of ratchet teeth are located on the underside of the tongue. The locking head has an integral movable pawl that is hinged at one side of an opening in the locking head. When the tip is inserted in the opening and pulled through the head, the pawl engages with the ratchet teeth to prevent the tip from being pulled back out of the opening.

When force is applied to an engaged cable tie, the tongue is pulled in a direction opposite to that in which it was inserted in the head. This causes the pawl to be pulled farther away from its attachment point, which pushes the tongue against the side of the opening opposite the pawl, termed the "abutment wall". If sufficient force is applied, the abutment wall can bow outward, which can cause the ratchet teeth to release from the pawl.

One manner to alleviate this bowing is to increase the thickness of the abutment wall. However, the increased thickness requires an increase in the residence time of the product in the injection mold, so that the plastic cools sufficiently before the mold is opened to prevent shrinkage of the abutment wall. One proposed solution to this problem is disclosed in U.S. Pat. No. 5,615,455. The abutment wall includes a plurality of apertures extending within the abutment wall parallel to the direction of insertion of the tip in the head. The apertures are not exposed to the abutment surface. The apertures are elongated, and pairs of apertures extend along a common axis from opposite ends of the abutment wall, but do not join each other. This design is described as not requiring as much material as a similar thickness solid wall and so not being significantly subject to deformation when the injected plastic material cools.

However, this product would be extremely difficult to manufacture. In order to create the apertures in the abutment wall, the mold would have to have a series of very small pins that would be subject to deformation and breakage. In addition, much of the abutment wall is substantially thicker than the rest of the walls of the head. Accordingly, this design likely would not significantly decrease the amount of time that the product would need to be maintained in the mold to cool sufficiently before it is ejected from the mold so as not to cause bowing of the abutment wall.

SUMMARY OF THE INVENTION

It is therefore an object of this invention to provide a cable tie with increased rigidity of the abutment wall while maintaining a relatively short mold residence time.

This invention features a cable tie comprising an elongated tongue with two ends and two broad sides, a tip at one end of the tongue, a set of ratchet teeth extending along one broad side of the tongue, a locking head at the other end of the tongue, the locking head having sides defining an opening for receiving the tip of the tongue, and a movable pawl that is hinged at one side of the opening, with another side of the opening defining an abutment wall that is across the opening from the pawl, and wherein the pawl engages with one or more of the ratchet teeth when the tongue has been inserted through the opening with the set of ratchet teeth facing the pawl. The abutment wall defines at least one protruding cross member, to strengthen the abutment wall.

There may be at least two cross members, and at least two of such cross members may be essentially perpendicular to one another. The cable tie may comprise at least a pair of longitudinal cross members that extend in total along at least a substantial portion of the length of the abutment wall in the direction of insertion of the tip of the tongue in the opening in the locking head. At least a pair of the longitudinal cross members may be colinear, extending along a common axis from opposite ends of the abutment wall, but not joining each other. The cable tie may comprise at least two parallel pairs of longitudinal cross members, the longitudinal cross members of each pair extending along a common axis from opposite ends of the abutment wall, but not joining each other, wherein the two axes are parallel but not colinear. The cross members of each colinear pair of cross members may be separated by an essentially perpendicular cross member, or at least one colinear pair of cross members may be separated by an essentially perpendicular cross member.

At least one cross member may be located on the portion of the abutment wall against which force is applied through the tongue by the portion of pawl that contacts the tongue when the tongue is forced against the surface of the abutment wall by the pawl. At least one cross member may extend in a direction that is essentially perpendicular to the direction of insertion of the tip of the tongue in the opening in the locking head. A transverse cross member may extend across essentially the entire extent of the surface of the abutment wall. At least one of the cross members may be located on the inside of the abutment wall. At least one of the cross members may be located on the outside of the abutment wall.

The abutment wall may have a nominal thickness, and at least one of the cross members may have a nominal width that is substantially the same as the abutment wall nominal thickness. The cable tie may comprise two parallel pairs of longitudinal cross members on the inside of the abutment wall and substantially equally spaced from one another and from the ends of the abutment wall, and an essentially perpendicular cross member separating the pairs and extending across essentially the entire width of the abutment wall, wherein each cross member has a nominal width that is substantially the same as the abutment wall nominal thickness. Two cross members may be spaced such that they lay directly across the opening from the edges of the pawl.

Featured in another embodiment is a cable tie comprising an elongated tongue with two ends and two broad sides, a tip at one end of the tongue, a set of ratchet teeth extending along one broad side of the tongue, and a locking head at the other end of the tongue. The locking head has sides defining an opening for receiving the tip of the tongue, and a movable pawl that is hinged at one side of the opening, with another side of the opening defining an abutment wall that is across the opening from the pawl. The pawl engages with one or more of the ratchet teeth when the tongue has been inserted through the opening with the set of ratchet teeth facing the pawl. The abutment wall defines at least a pair of protruding longitudinal cross members that extend in total along at least a substantial portion of the length of the abutment wall in the direction of insertion of the tip of the tongue in the opening in the locking head, and at least one essentially perpendicular cross member that intersects the longitudinal cross members, to strengthen the abutment wall.

The abutment wall may have a nominal thickness, and the cross members may have a nominal width that is substantially the same as the abutment wall nominal thickness. The cable tie may comprise two parallel pairs of longitudinal cross members on the inside of the abutment wall and substantially equally spaced from one another and from the ends of the abutment wall, and an essentially perpendicular cross member separating the pairs and extending across essentially the entire width of the abutment wall, wherein each cross member has a nominal width that is substantially the same as the abutment wall nominal thickness. The two pairs of longitudinal cross members may be spaced such that they lay directly across the opening from the edges of the pawl.

BRIEF DESCRIPTION OF THE DRAWINGS

Other objects, features and advantages will occur to those skilled in the art from the following description of the preferred embodiments, and the accompanying drawings, in which.

DETAILED DESCRIPTION OF THE PREFERRED EMBODIMENTS

The invention may be accomplished in a cable tie in which the abutment wall of the cable tie head is reinforced with at least two transverse cross members located on one or both surfaces of the abutment wall. The cross members reinforce the wall to inhibit its buckling under substantial loads, while maintaining a profile that does not substantially increase the residence time required in the mold to solidify the abutment wall.

Figure 1A:
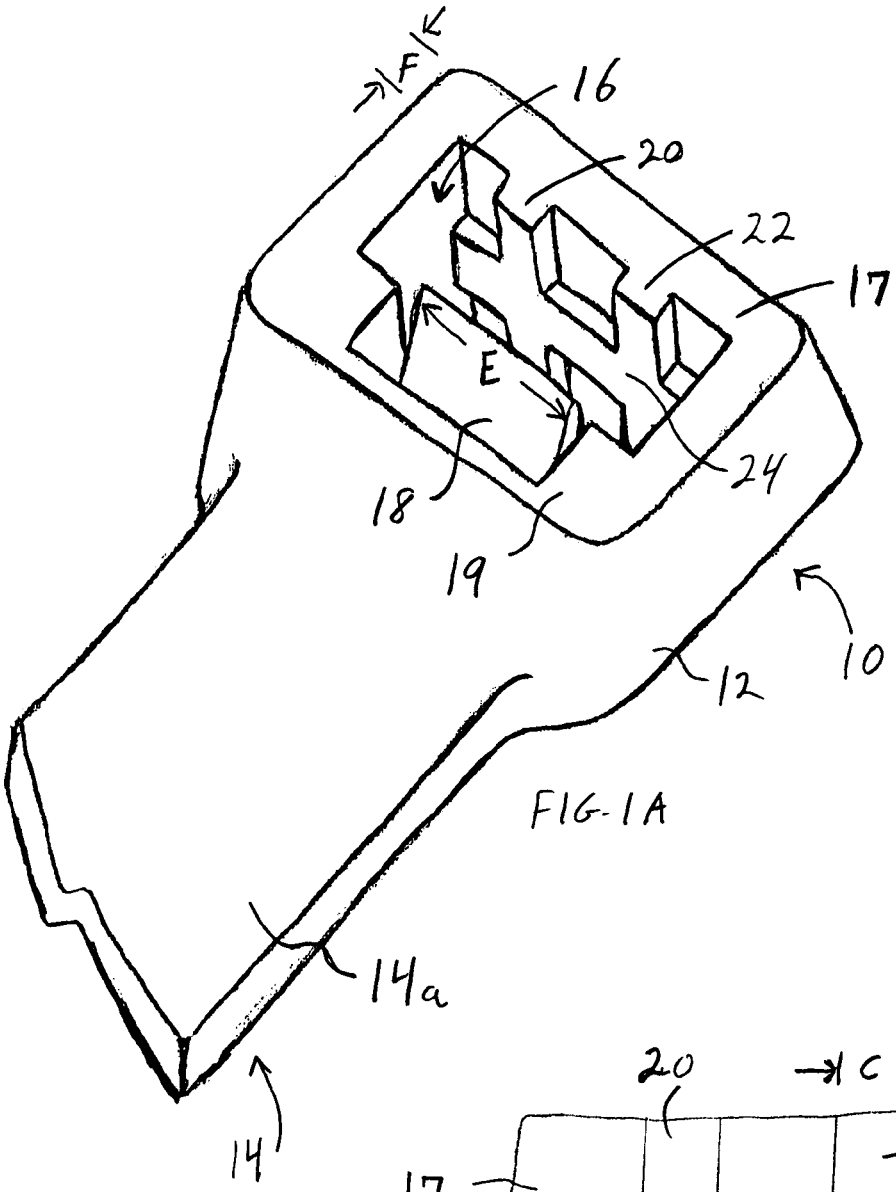
FIG. 1A is a partial perspective view of a preferred embodiment of the cable tie of the invention.
Figure 1B:
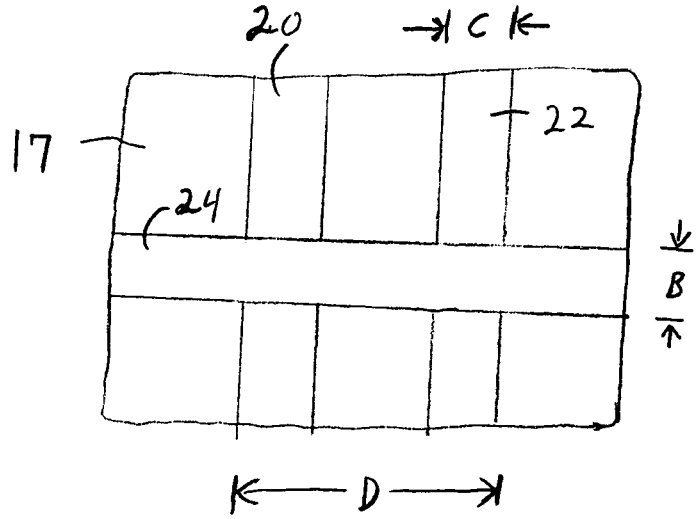
FIG. 1B is a simplified view of the interior of the abutment wall of the cable tie of FIG. 1A.
Figure 1C:
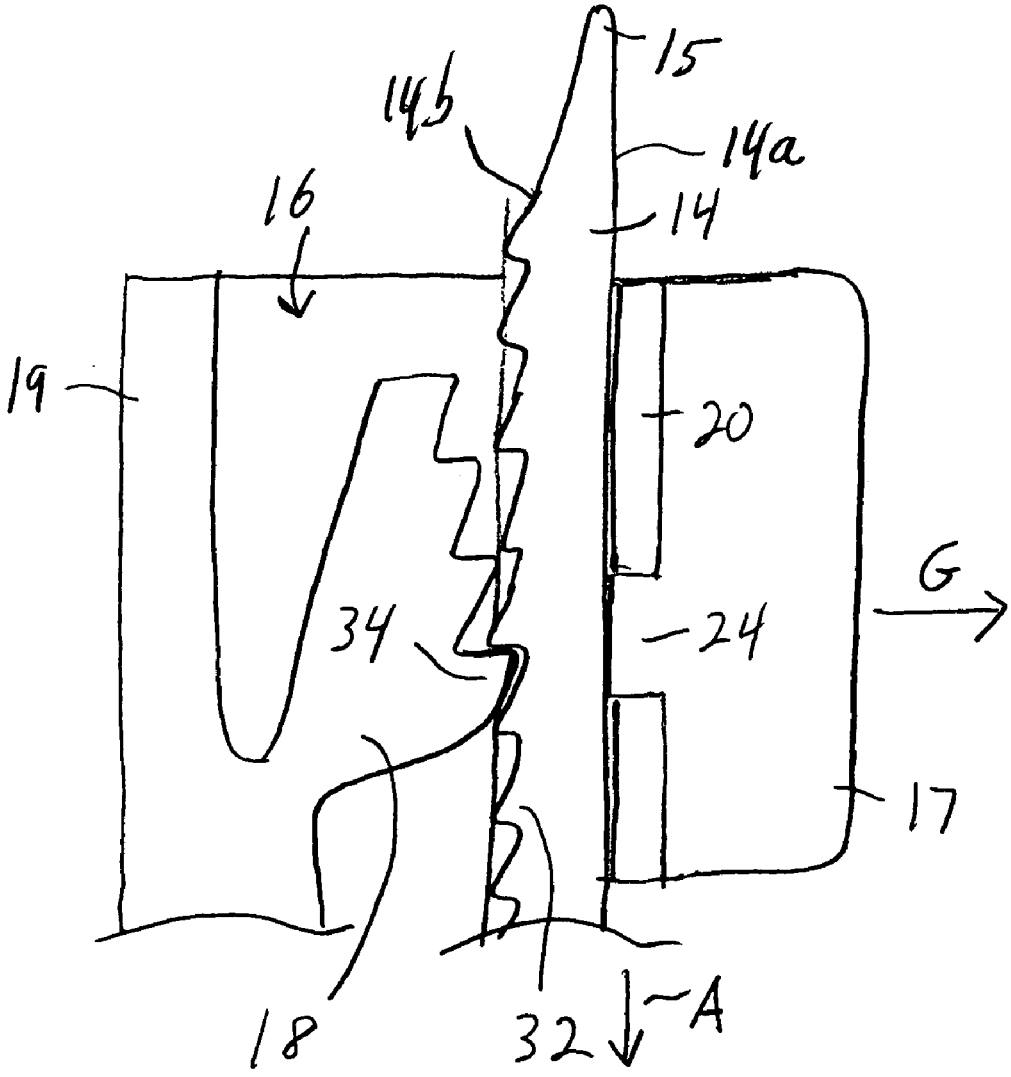
FIG. 1C is a partial cross sectional view of the head of the cable tie shown in FIG. 1A with the ratchet teeth of the tongue engaged with the pawl in the head.

FIGS. 1A–1C depict a preferred embodiment of the inventive cable tie. Cable tie 10 comprises elongated tongue 14 with broad upper side 14*a* and broad lower side 14*b*. Head 12 is located at one end of tongue 14, and tip 15 at the other end. Locking head 12 defines opening 16 for receiving tip 15 of tongue 14. Integral moveable pawl 18 is hinged at side 19 of head 12. Across opening 16 from pawl 18 is abutment wall 17. Wall 17 is strengthened by the inclusion of at least one protruding cross member. Although the cross member or cross members can be located on the inside and/or outside of abutment wall 17, in the preferred embodiment there are at least two vertical and at least one horizontal perpendicular cross members 20, 22 and 24, respectively, located on the inside surface of abutment wall 17, as shown.

As shown in FIG. 1C, transverse cross member 24 is arranged to lie at about the location at which pawl 18 pushes tongue 14 against wall 17, which occurs when ratchet teeth 32 on the underside 14*b* of tongue 14 engage with complimentary ratchet teeth 34 on pawl 18. Force applied to tongue 14 in the direction of arrow A tends to pivot pawl 18 towards wall 17, and thereby increase the pressure against wall 17. Cross members 20, 22 and 24 strengthen wall 17 to thereby inhibit bowing of wall 17 upon application of this force.

In this preferred embodiment, the width C of vertical or longitudinal cross members 20 and 22, and the width B of transverse cross member 24, are essentially equal and are approximately the same as the nominal thickness F of abutment wall 17. This dimensional arrangement provides for much more uniform cooling of wall 17, which allows wall 17 to solidify quickly, thus reducing molding cycle time and effectively increasing product yield.

In order to maximize the strength provided by this arrangement of cross members, cross member 24 is arranged at about the location of the maximum outward force in the direction of arrow G that occurs when tongue 14 is pulled in the direction of arrow A. Additionally, distance D between the outer edges of longitudinal of cross members 20 and 22 is preferably approximately the same as the width E of pawl 18 so that the force created by pawl 18 is carried by the three cross members.

Other arrangements of one or more cross members are contemplated in alternative embodiments of the invention. When one wall reinforcing beam member is used, it is still called a "cross member", even though it does not intersect with another reinforcing member. However, abutment wall 17 is best strengthened by at least two cross members, at least two of which intersect along one face of the abutment wall. Or, when the cross members are located on both the inside and outside of the abutment wall, when they are arranged such that their longitudinal axes are not parallel. This can encompass cross members meeting at any angle. The width and thickness of the cross members is also not a limitation of the invention.

Figure 2A:
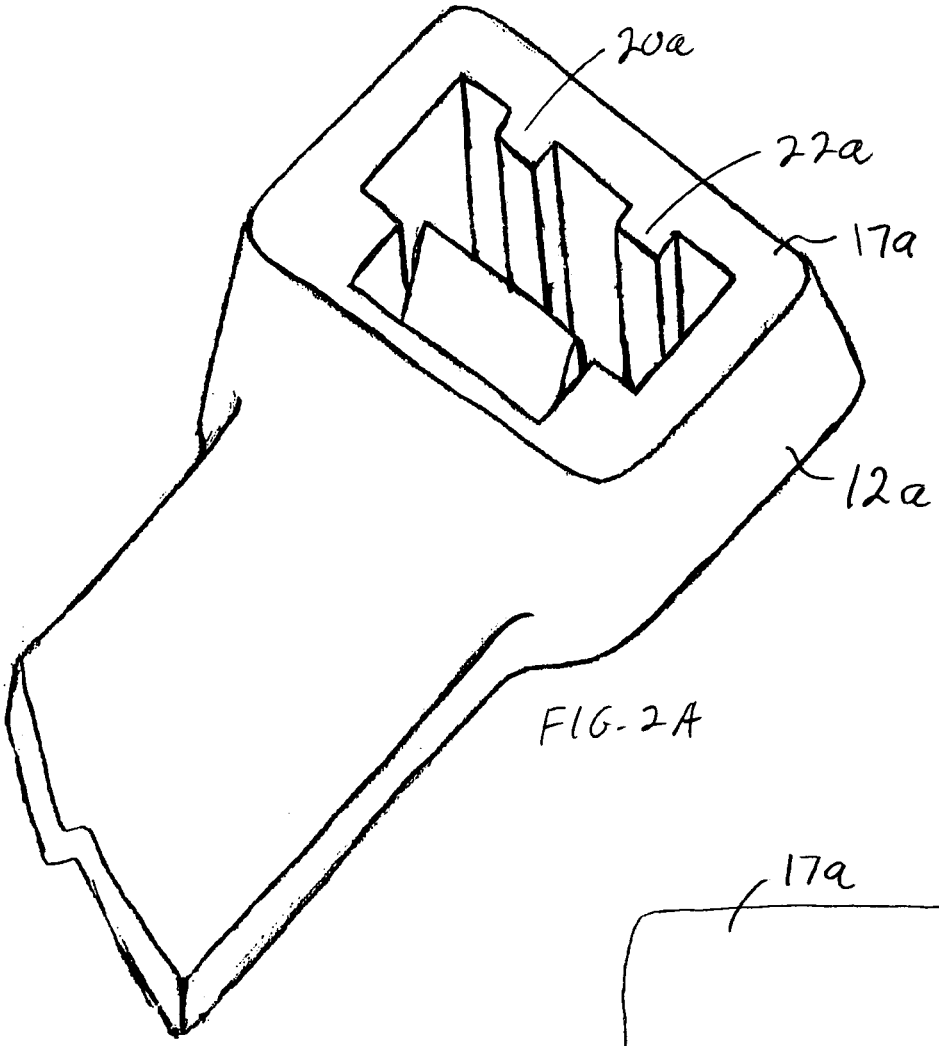
FIG. 2A is a view similar to that of FIG. 1A, but for an alternative preferred embodiment of the invention.
Figure 2B:
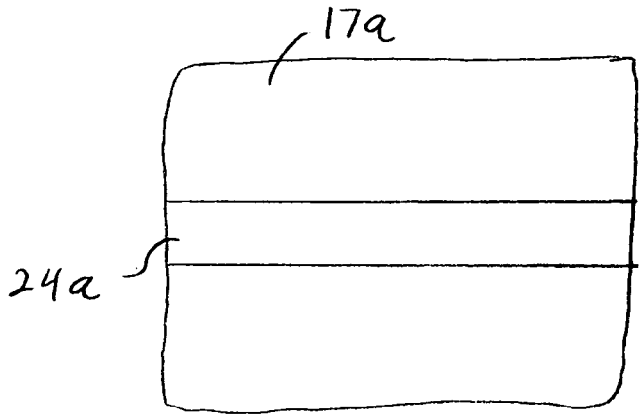
FIG. 2B is an external view of the abutment wall of the head of the cable tie shown in FIG. 2A.
Figure 3:
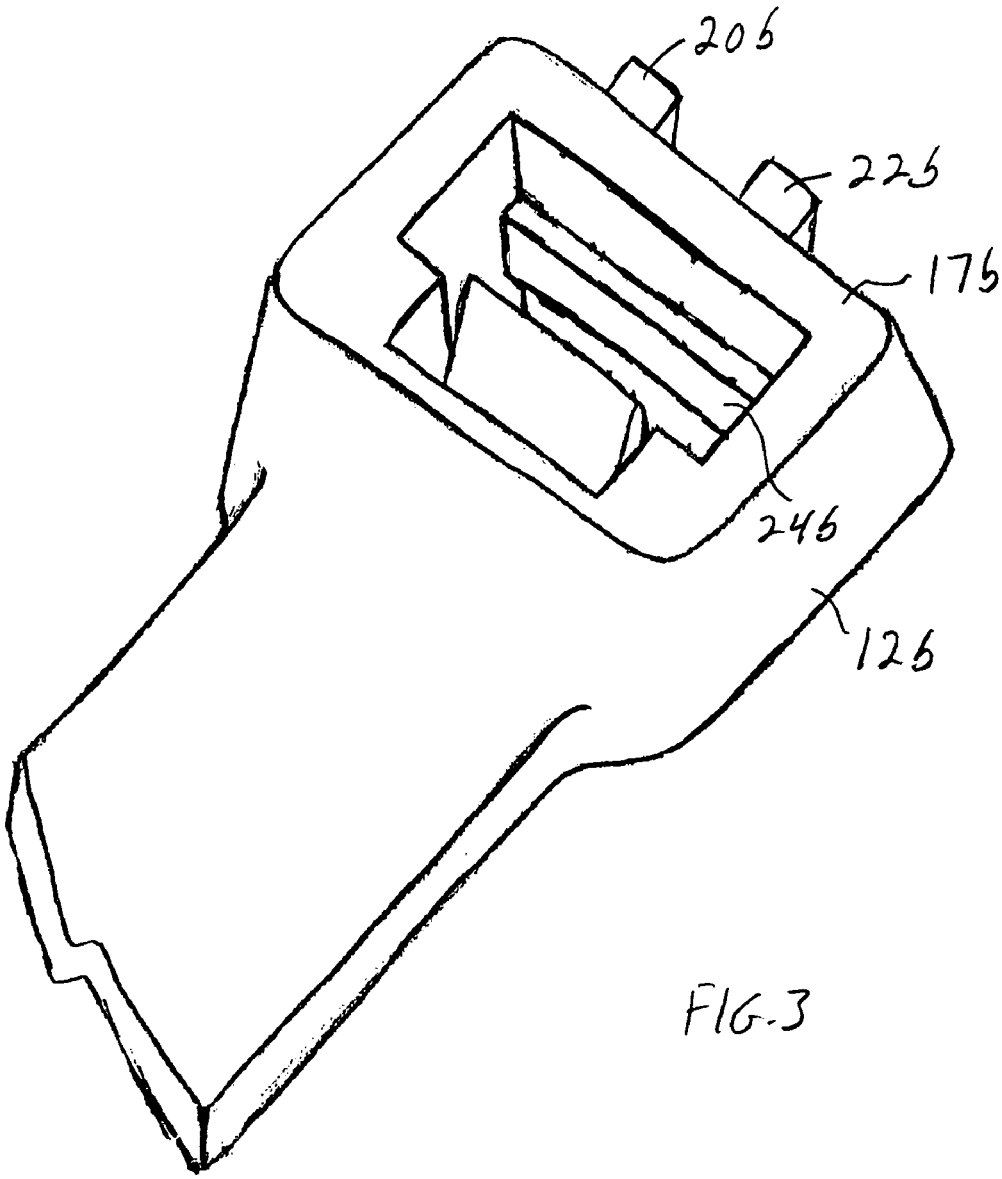
FIG. 3 is a view similar to those of FIGS. 1A and 2A of another alternative preferred embodiment of the invention.

FIGS. 2A and 2B depict one manner of accomplishing effectively the same cross members as in the embodiment of FIGS. 1A–1C, but utilizing both the inside and outside of the abutment wall. FIG. 3 reverses the arrangement of the cross members shown in FIGS. 2A and 2B. Interior longitudinal cross members 20*a* and 22*a*, FIG. 2A, are essentially the same as cross members 20 and 22, except that members 20*a* and 22*a* extend uninterrupted along the entire height of abutment wall 17*a*. Transverse cross member 24*a* is located on the outside surface of wall 17*a*, and also extends uninterrupted across the width of wall 17*a*. Otherwise, in this embodiment, the widths of the cross members and their locations relative to pawl 18 are the same as for the first embodiment. In the third embodiment shown in FIG. 3, transverse cross member 24*b* is located on the inside rather than the outside surface of abutment wall 17*b*, and longitudinal cross members 20*b* and 22*b* are located on the outside surface of abutment wall 17*b*.

The cross members of the invention are integrally formed during the injection molding of the inventive cable tie. The cross members are created by appropriately designing the tool portions comprising the mold for the cable tie. For example, as compared to a traditional cable tie with a flat interior face to abutment wall 17, the preferred embodiment of FIGS. 1A–1C can be created with a tool that defines the cavity 16 with its faces that form abutment wall 17 modified to create integral cross members 20, 22 and 24.

Although features of this invention are shown in some drawings and not others, this is not a limitation of the invention. Also, other embodiments would be apparent to those skilled in the art from the previous description and the following claims.

What is claimed is:

1. A cable tie, comprising:

an elongated tongue with two ends and two broad sides;

a tip at one end of the tongue;

a set of ratchet teeth extending along one broad side of the tongue;

a locking head at the other end of the tongue, the locking head having sides defining an opening for receiving the tip of the tongue, and a movable pawl that is hinged at one side of the opening, with another side of the opening defining an abutment wall that is across the opening from the pawl, and wherein the pawl engages with one or more of the ratchet teeth when the tongue has been inserted through the opening with the set of ratchet teeth facing the pawl;

wherein the abutment wall defines at least two protruding cross members, to strengthen the abutment wall.

2. The cable tie of claim 1, wherein the at least two cross members are essentially perpendicular to one another.

3. The cable tie of claim 1, wherein the at least two cross members are at least a pair of longitudinal cross members that extend in total along at least a substantial portion of the length of the abutment wall in the direction of insertion of the tip of the tongue in the opening in the locking head.

4. The cable tie of claim 3, wherein at least a pair of the longitudinal cross members are colinear, extending along a common axis from opposite ends of the abutment wall, but not joining each other.

5. The cable tie of claim 4, wherein the at least two cross members are at least two parallel pairs of longitudinal cross members, the longitudinal cross members of each pair extending along a common axis from opposite ends of the abutment wall, but not joining each other, wherein the two axes are parallel but not colinear.

6. The cable tie of claim 5, wherein the cross members of each colinear pair of cross members are separated by an essentially perpendicular cross member.

7. The cable tie of claim 4, wherein at least one colinear pair of cross members is separated by an essentially perpendicular cross member.

8. The cable tie of claim 1, wherein at least one cross member is located on the portion of the abutment wall against which force is applied through the tongue by the portion of pawl that contacts the tongue when the tongue is forced against the surface of the abutment wall by the pawl.

9. The cable tie of claim 8, wherein at least one cross member extends in a direction that is essentially perpendicular to the direction of insertion of the tip of the tongue in the opening in the locking head.

10. The cable tie of claim 9, wherein a transverse cross member extends across essentially the entire extent of the surface of the abutment wall.

11. The cable tie of claim 1, wherein at least one of the cross members is located on the inside of the abutment wall.

12. The cable tie of claim 1, wherein at least one of the cross members is located on the outside of the abutment wall.

13. The cable tie of claim 1, wherein the abutment wall has a nominal thickness, and at least one of the cross members has a nominal width that is substantially the same as the abutment wall nominal thickness.

14. The cable tie of claim 13, wherein the at least two cross members are two parallel pairs of longitudinal cross members on the inside of the abutment wall and substantially equally spaced from one another and from the ends of the abutment wall, and an essentially perpendicular cross member separating the pairs and extending across essentially the entire width of the abutment wall, wherein each cross member has a nominal width that is substantially the same as the abutment wall nominal thickness.

15. The cable tie of claim 1, wherein the at least two cross members are spaced such that they lay directly across the opening from the edges of the pawl.

16. A cable tie, comprising:

an elongated tongue with two ends and two broad sides;

a tip at one end of the tongue;

a set of ratchet teeth extending along one broad side of the tongue;

a locking head at the other end of the tongue, the locking head having sides defining an opening for receiving the tip of the tongue, and a movable pawl that is hinged at one side of the opening, with another side of the opening defining an abutment wall that is across the opening from the pawl, and wherein the pawl engages with one or more of the ratchet teeth when the tongue has been inserted through the opening with the set of ratchet teeth facing the pawl;

wherein the abutment wall defines at least a pair of protruding longitudinal cross members that extend in total along at least a substantial portion of the length of the abutment wall in the direction of insertion of the tip of the tongue in the opening in the locking head, and at least one essentially perpendicular cross member that intersects the longitudinal cross members, to strengthen the abutment wall.

17. The cable tie of claim 16, wherein the abutment wall has a nominal thickness, and the cross members have a nominal width that is substantially the same as the abutment wall nominal thickness.

18. The cable tie of claim 16, comprising two parallel pairs of longitudinal cross members on the inside of the abutment wall and substantially equally spaced from one another and from the ends of the abutment wall, and an essentially perpendicular cross member separating the pairs and extending across essentially the entire width of the abutment wall, wherein each cross member has a nominal width that is substantially the same as the abutment wall nominal thickness.

19. The cable tie of claim 16, wherein the two pairs of longitudinal cross members are spaced such that they lay directly across the opening from the edges of the pawl.

* * * * *